US006848252B2

(12) United States Patent
Maybeck

(10) Patent No.: US 6,848,252 B2
(45) Date of Patent: Feb. 1, 2005

(54) EXHAUST ENHANCEMENT FOR AFTERMARKET MOTORCYCLE EXHAUST PIPES WITH A STRAIGHT PIPE TYPE DESIGN AND WITH INSIDE PIPE DIAMETER FROM 1.875" AND LARGER

(76) Inventor: James Charles Maybeck, 115 S. Canterbury Rd., Charlotte, NC (US) 28211

( * ) Notice: Subject to any disclaimer, the term of this patent is extended or adjusted under 35 U.S.C. 154(b) by 0 days.

(21) Appl. No.: 10/408,860

(22) Filed: Apr. 7, 2003

(65) Prior Publication Data

US 2004/0123592 A1 Jul. 1, 2004

Related U.S. Application Data

(60) Provisional application No. 60/387,005, filed on Jun. 6, 2002.

(51) Int. Cl.[7] ..... F02B 27/02

(52) U.S. Cl. ..... 60/312; 60/313; 60/314; 60/322; 60/324; 181/216; 181/227; 181/241

(58) Field of Search ..... 60/312, 313, 314, 60/322, 323, 324; 181/227, 204, 215, 216, 217, 241

(56) References Cited

U.S. PATENT DOCUMENTS

| | | | | | |
|---|---|---|---|---|---|
| 4,356,885 | A | * | 11/1982 | Dello | 181/227 |
| 5,508,478 | A | * | 4/1996 | Barry | 181/227 |
| 5,663,537 | A | * | 9/1997 | Ko et al. | 181/228 |
| 6,085,863 | A | * | 7/2000 | Shuen | 181/228 |
| 6,343,673 | B1 | * | 2/2002 | Chang | 181/227 |
| 6,367,580 | B1 | * | 4/2002 | Chang | 181/241 |
| 6,520,285 | B2 | * | 2/2003 | Tobias | 181/241 |

* cited by examiner

*Primary Examiner*—Binh Q. Tran
(74) *Attorney, Agent, or Firm*—Alston & Bird LLP

(57) ABSTRACT

Sound and power are an important part of the motorcycling experience. From the early days people have been attempting to get it "right" and have tried numerous ways to achieve the best of both worlds. Generally one had to be sacrificed to some degree to get the other. Tuning the exhaust rather than tuning the carburetor or increasing cubic inches is a less expensive and more efficient way to get both the sound and midrange power that motorcyclists are looking for. With the Exhaust Enhancement exhaust pipes can be tuned for sound and increased midrange power very simply and easily by installing them in the exit end of an aftermarket straight type pipe using various combinations to achieve a desired sound and not sacrifice power.

13 Claims, 5 Drawing Sheets

EXHAUST ENHANCEMENT FOR AFTERMARKET MOTORCYCLE EXHAUST PIPES WITH A STRAIGHT PIPE TYPE DESIGN AND WITH INSIDE PIPE DIAMETER FROM 1.875" AND LARGER

CROSS-REFERENCE TO RELATED APPLICATIONS

This application claims domestic priority from U.S. Provisional Application No. 60/387,005 filed Jun. 6, 2002.

BACKGROUND OF THE INVENTION

Motorcyclists have always sought the right blend of sound and performance from their motorcycles. With the development of aftermarket exhaust pipes motorcyclists gained horsepower and performance but had less sound. When they removed the baffles they sacrificed performance to gain sound. No one has previously been successful in attaining sound and performance from straight pipe type design aftermarket exhaust pipes. The Exhaust enhancer focuses on lessening reversion which increases horsepower, allows for a deeper more appealing sound and helps lessen the throttle hesitation that can develop when baffles are removed. This is the first product that has been able to consistently address the above issues and remedy them.

BRIEF SUMMARY OF THE INVENTION

The present invention relates to an exhaust enhancement device for motorcycle exhaust pipes, and is especially applicable to aftermarket motorcycle exhaust pipes with a straight pipe design and with an inside diameter from 1.875 inch and larger. The exhaust enhancement device, when used with its internal additions, allows motorcyclists to essentially tune the motorcycle to the sound and the power band that they are wanting by selecting one or more internal additions, referred to herein as the ThunderBolt and the Thunder Probe, or a combination of the two, to achieve the desired result. While obtaining the desired enhanced sound and power, the user will have the additional benefit of better throttle response and the rpm's will not drop off as radically between shifts.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 1 schematically illustrates a motorcycle engine with a pair of exhaust pipes, and shows where the exhaust enhancers are located in the exhaust pipe.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
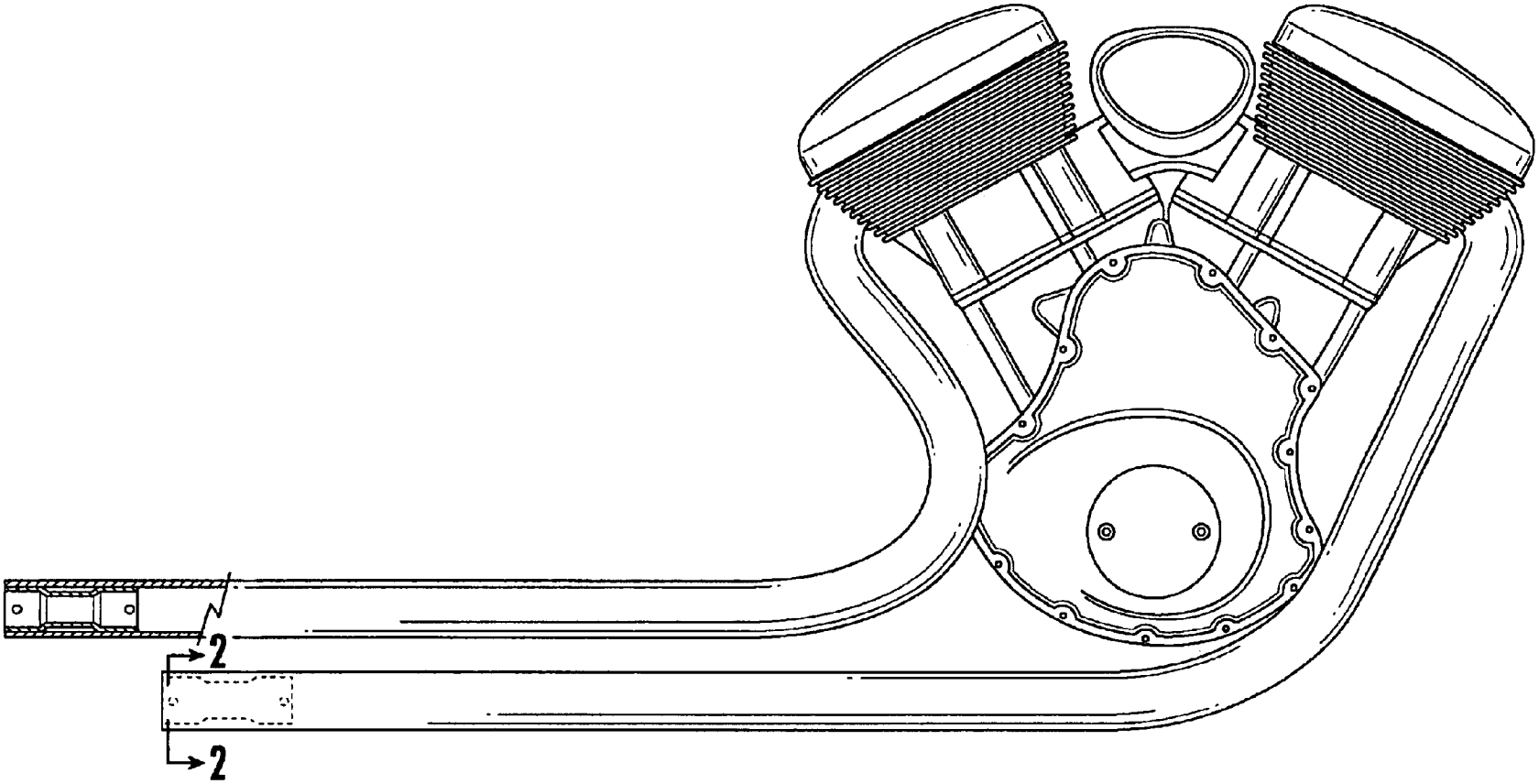
Figure 2:
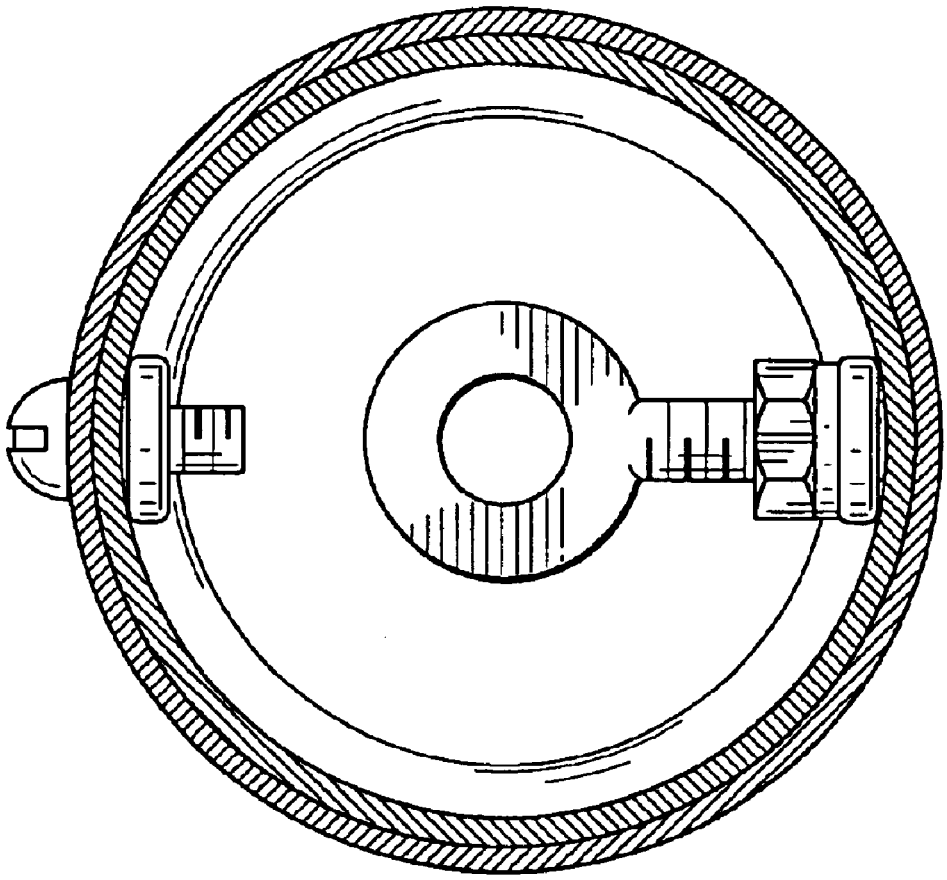
FIG. 2 is a cross-sectional view of the exhaust enhancer taken substantially along the line 2—2 in FIG. 1 and showing the exhaust enhancer in place with a ThunderBolt.
Figure 3:
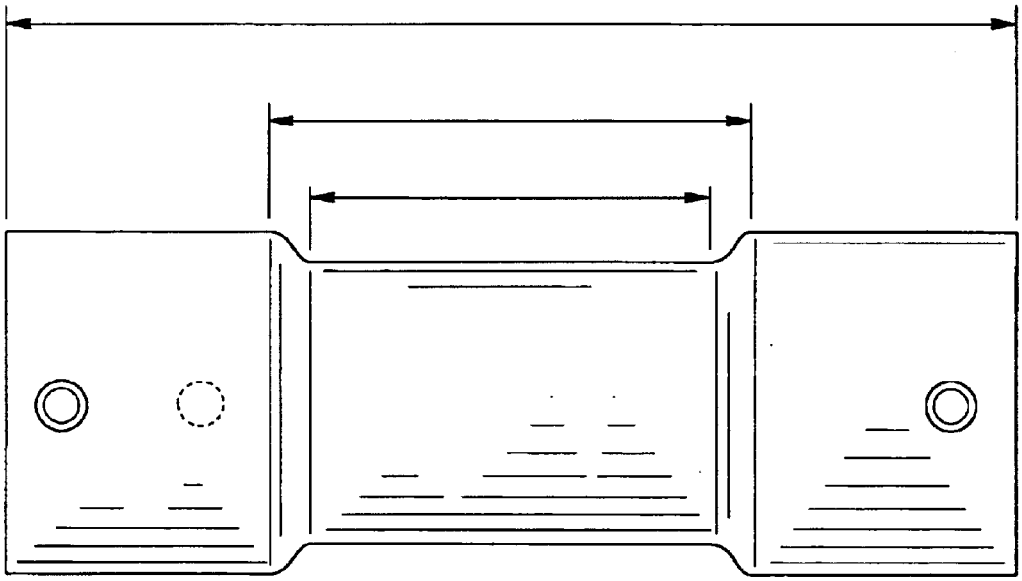
FIG. 3 is a plan view of an exhaust enhancer with the holes shown. This is what is put into the exit end of the exhaust pipe and secured by a button head bolt where the stock baffles were located.

As shown in FIG. 1, the exhaust enhancer, which is indicated generally by the reference number 10, is installed inside a motorcycle exhaust pipe 20 adjacent its discharge end. The main body of the exhaust enhancer is made from high carbon steel tubing 1.74 inches in diameter that is cut to a length of approximately 4.5 inches. Each end of the tubing is swaged or expanded to various diameters (dependent on the exhaust pipe into which it will be installed) to form cylindrical end portions 11 of uniform diameter, leaving a reduced diameter center chamber portion 12 of approximately 2 inches in length and 1.75 inches outside diameter. Thus, as best seen in FIG. 2, the cylindrical end portions 11 of the exhaust enhancer 10 has an outside diameter that is close to the inside diameter of the exhaust pipe 20 so that the exhaust enhancer 10 will be received within the exhaust pipe 20. The exhaust enhancers 10 are dipped in a black oxide solution that heat treats them and helps stop rust and corrosion. There are three holes punched in each enhancer—two opposite each other on the same side of the enhancer, located in the cylindrical end portions 11 of the enhancer, and one on the opposite side of the enhancer just before the center chamber 12 or in the center chamber, it can be used either way. Weld nuts 13 are spot welded inside the chamber at each punched hole in order to locate the baffling/anti-reversion device/devices and the button head that locates the enhancer 10 securely in the exhaust pipe 20.

Figure 4:
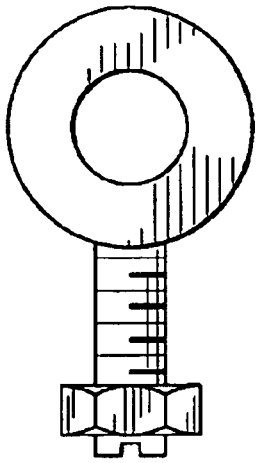
FIG. 4 is a view of the ThunderBolt that can be located in the center chamber or in one end of the exhaust enhancer or it can be used in combination with the Thunder Probe.

One of the baffling/anti-reversion pieces is the ThunderBolt 15 (see FIG. 4) which is made from a threaded ¼ 20 Alan head screw with a 316 stainless steel washer that is heliarc welded to the top of the Alan screw using stainless steel rod. Once they are welded they are then polished to harden and smooth them.

Figure 5:
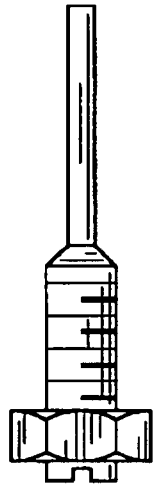
FIG. 5 is a view of the Thunder Probe that can be located in the center chamber or in one end of the exhaust enhancer or it can be used in combination with the ThunderBolt.

The other baffling/anti-reversion piece is the Thunder Probe 16 (see FIG. 5) which is made from a threaded ¼ 20 Alan screw that has been machined to remove a portion of the threads. With this design it can be located in any of the holes in the enhancer 10.

A baffling/anti-reversion piece 15 or 16 is mounted by threading the threaded shaft of the piece into one of the weld nuts 13 on the inside of the cylindrical body and is held tightly in place by tightening a lock nut 18 against the weld nut 13.

The baffling/anti-reversion pieces 15, 16 located in the enhancer 10 act to create a vortex which allows the exhaust gases to exit the pipe more efficiently and helps lessen reversion which is what lessens horsepower in a motorcycle engine, due to the diluting of the charge entering the combustion chamber which is caused by valve overlap. By reducing the amount of reversion that occurs the rider will experience improved throttle response, a deeper sound, more midrange power, and more torque than with no baffling device in the exhaust pipe. Dyno testing has shown that the enhancer 10 with the ThunderBolt 15 installed can produce 12 midrange horsepower when installed in an exhaust pipe that had not had any baffling device previously installed. When installed in place of a stock baffle using the Enhancer with a ThunderBolt installed it will produce the same horsepower and torque as the baffle.

Figure 6:
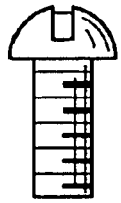
FIG. 6 is a view of the button head bolt used to locate the exhaust enhancer in the exhaust pipe.
Figure 7A:
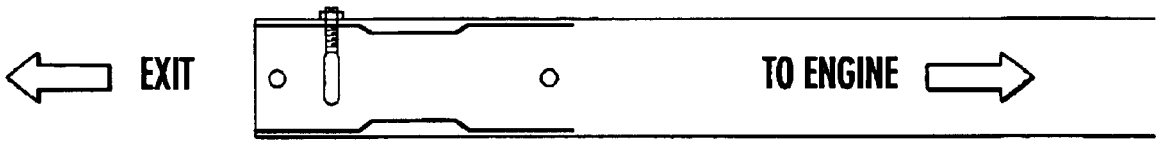
FIGS. 7A to 7F are views demonstrating several of the combinations that can be used with the exhaust enhancer using the ThunderBolts and Thunder Probes in various locations within the exhaust enhancer.
Figure 7B:
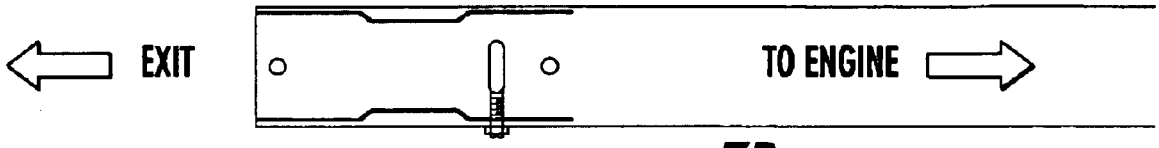
Figure 7C:
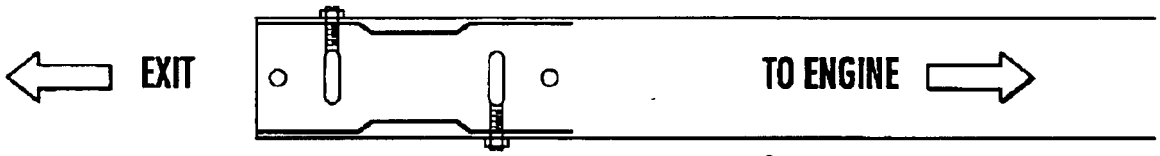
Figure 7D:
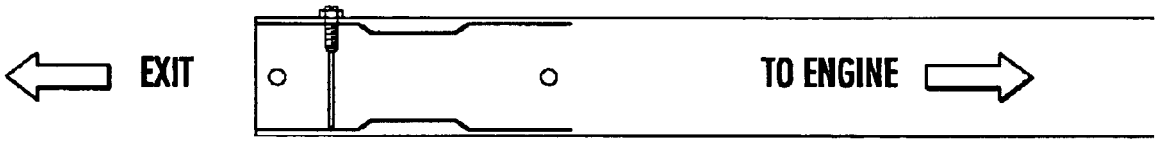
Figure 7E:
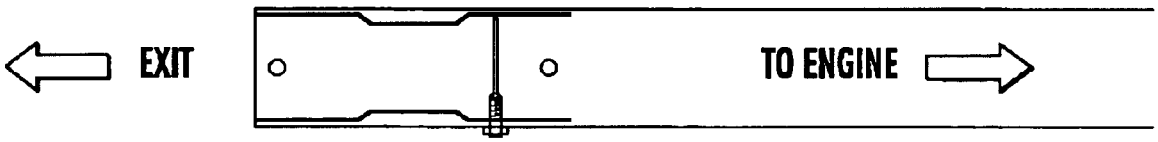
Figure 7F:
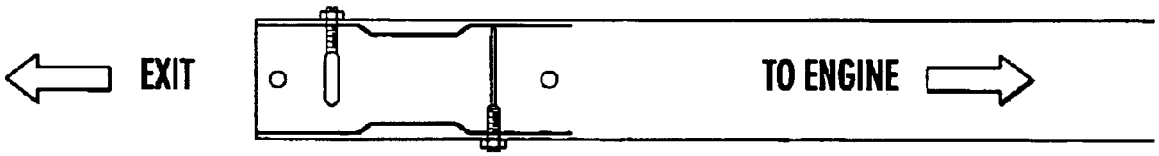
Figure 1:
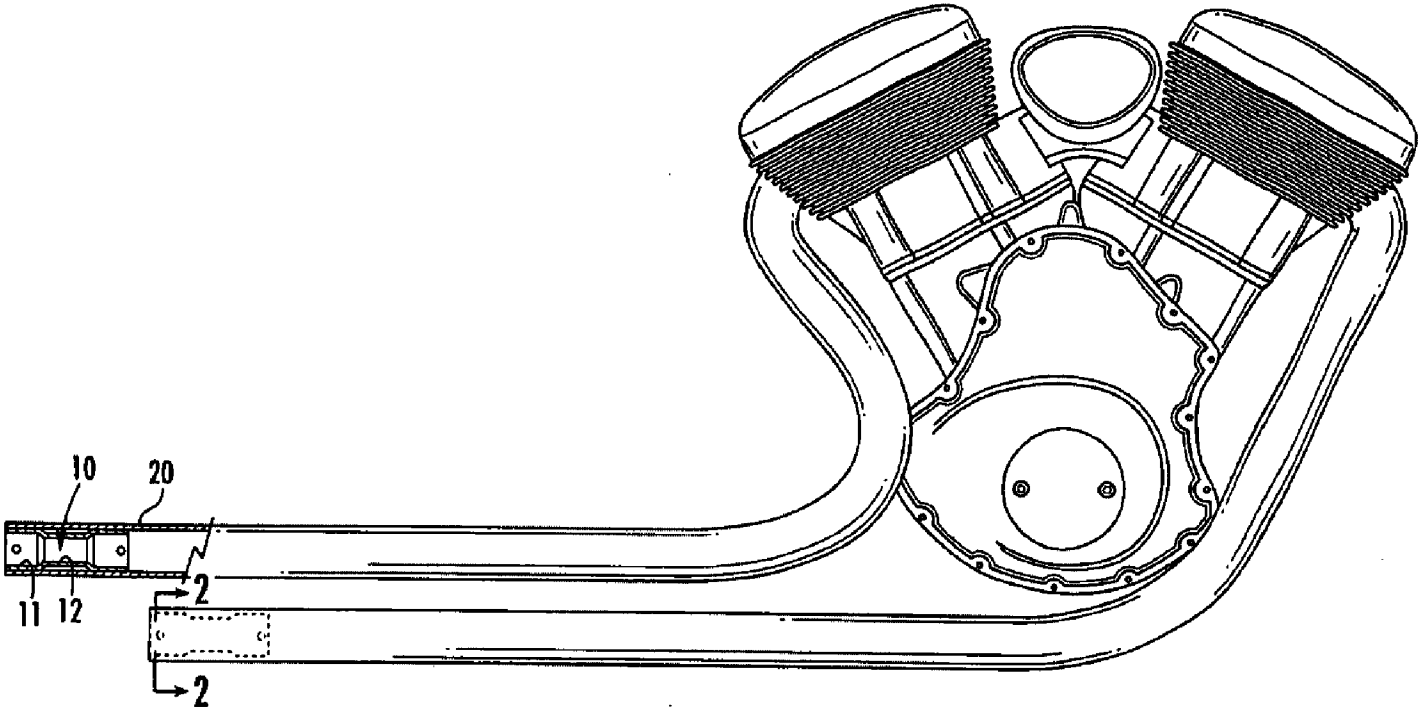
Figure 2:
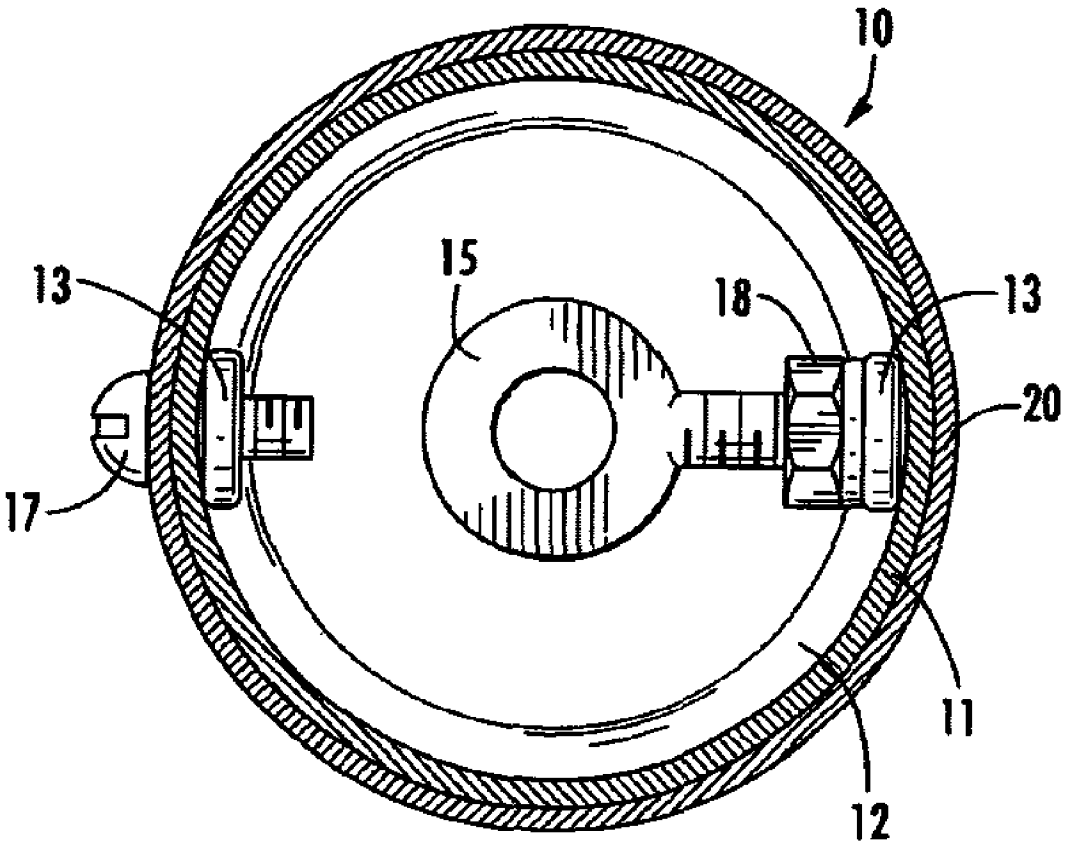
Figure 3:
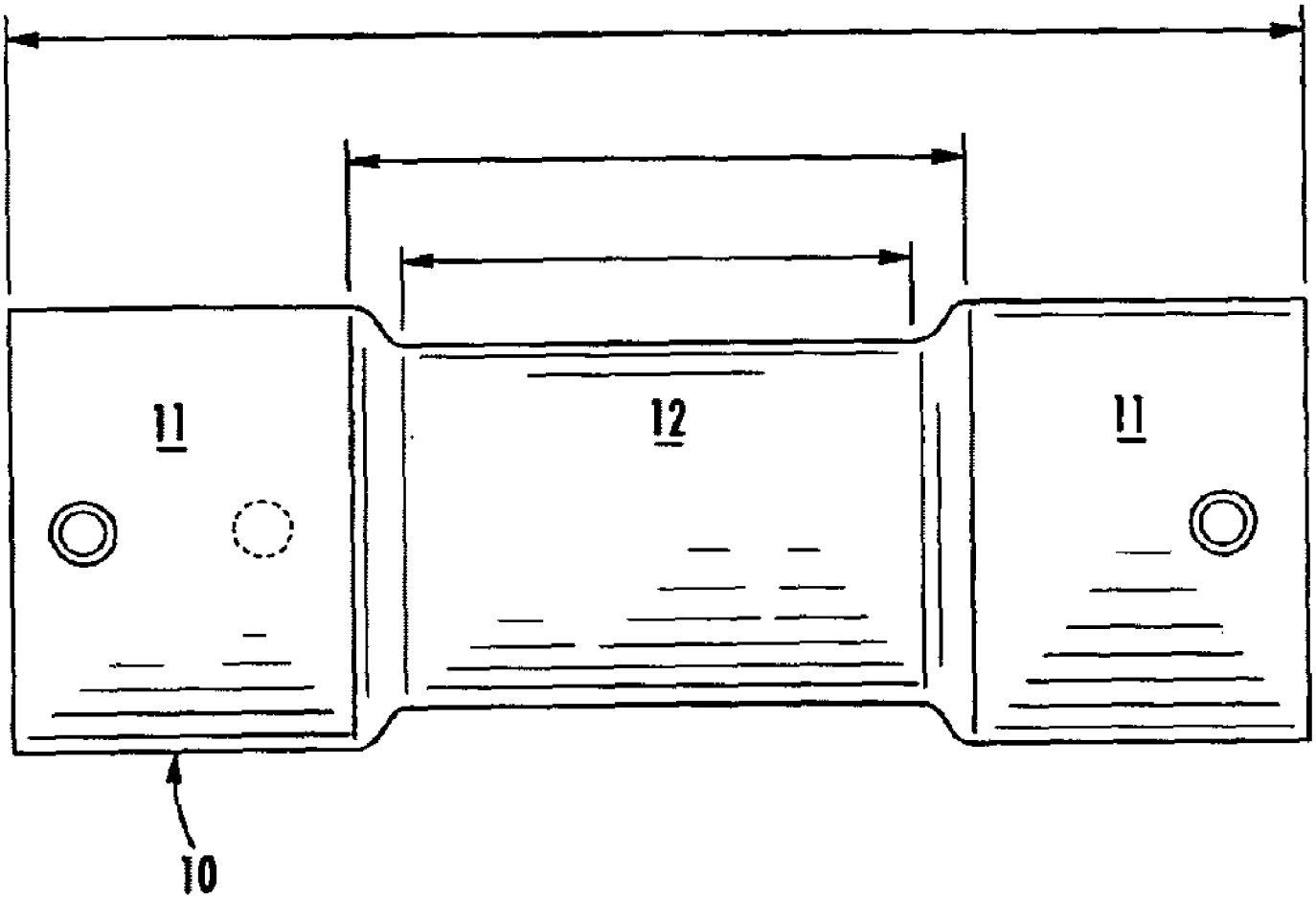
Figure 4:
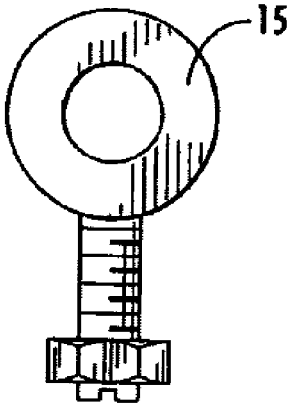
Figure 5:
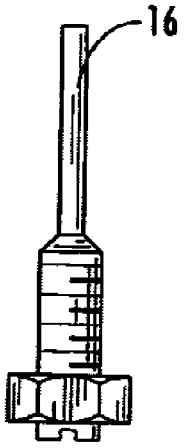
Figure 6:
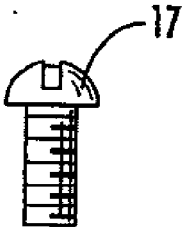
Figure 7A:
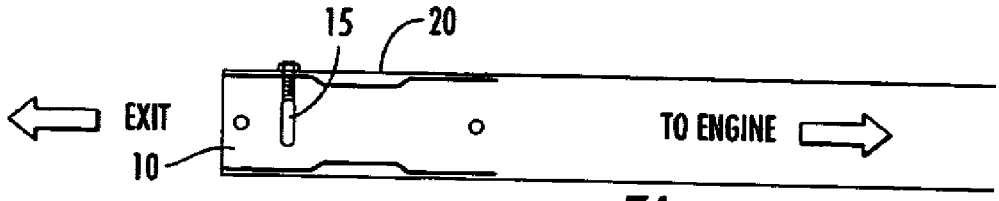
Figure 7B:
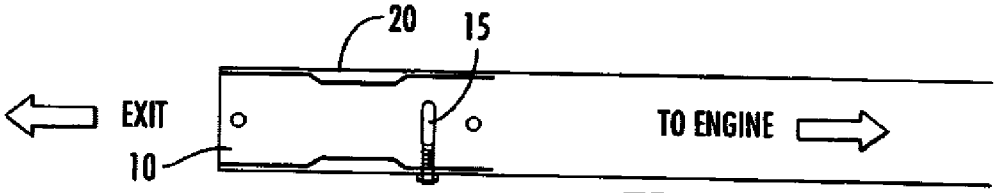
Figure 7C:
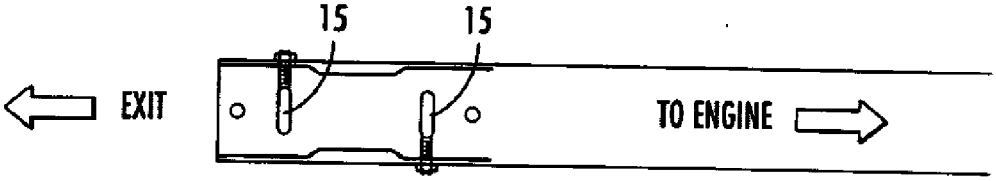
Figure 7D:
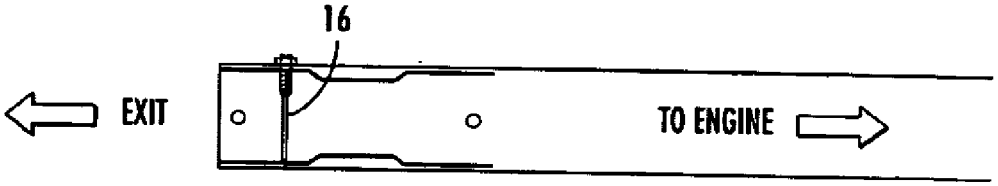
Figure 7E:
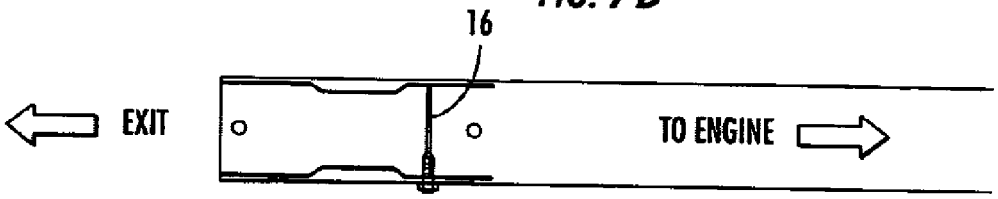
Figure 7F:
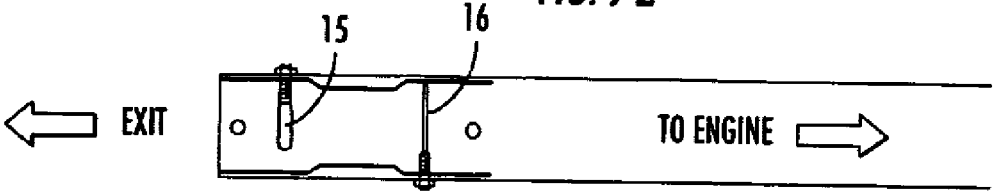

To install the enhancer 10, the existing baffles in the exhaust pipe 20 must be removed. For safety they should be removed when the pipes are cool. Using an Alan wrench, remove the button head bolt holding the baffle in place and pull the baffle out the exit end of the pipe. Once out, the enhancer 10 can be slid in the pipe and located using the existing hole in the exhaust pipe 20. Once located, insert the new button head bolt 17 (see FIG. 6) supplied with the product to secure the Enhancer 10 in the pipe 20. The Enhancer can be installed in a straight type exhaust pipe. Previously designed baffles were not able to alter the sound and produce an increase in horsepower and torque.

Using the ThunderBolts 15 and Thunder Probes 16 in various combinations or singly, as shown in FIGS. 7A to 7F for example, the pipes can be made deeper in sound and quieter while increasing the amount of horsepower and torque due to the effect that the enhancer has on reversion.

If the Enhancer is installed on a motorcycle with fuel injection, the bike should be run for a few minutes to allow it to read and readjust to the new exhaust flow.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An exhaust enhancement device for a motorcycle exhaust pipe comprising a tubular cylindrical body having cylindrical end portions of substantially uniform diameter configured to be received within a motorcycle exhaust pipe adjacent the exit end thereof, and a reduced diameter portion located between said cylindrical end portions and an anti-reversion piece mounted on said tubular cylindrical body and projecting radially inwardly therefrom to at least the center of the tubular body and into path of exhaust gases through the tubular cylindrical body.

2. The device of claim 1, including a threaded hole provided in said tubular cylindrical body adapted for receiving a threaded fastener for securing the device within the exhaust pipe.

3. The device of claim 1, including at least one additional threaded hole provided in said tubular cylindrical body, and wherein said anti-reversion piece is threaded into said at least one additional threaded hole and projects into the interior of the tubular cylindrical body.

4. The device of claim 3, wherein said anti-reversion piece comprises a threaded shaft and a washer welded to said shaft.

5. The device of claim 3, wherein said anti-reversion piece comprises a shaft having a threaded portion threaded into said threaded hole and an unthreaded portion projecting into the interior of the tubular cylindrical body.

6. The device of claim 3, additionally including a lock nut threaded onto said anti-reversion piece and tightened against said threaded hole.

7. The device of claim 2, wherein said threaded hole comprises a hole formed in said tubular cylindrical body and a threaded nut positioned over said hole and welded to the interior surface of the cylindrical body.

8. An exhaust enhancement device for a motorcycle exhaust pipe comprising a tubular cylindrical body formed of steel tubing, said body having cylindrical end portions of substantially uniform diameter joined by an integral central portion of substantially uniform diameter, a first hole formed in said cylindrical body, a first threaded nut positioned over said hole on the interior of said cylindrical body and secured in place by welding, a fastener having threads configured for engagement with said first threaded nut for securing the exhaust enhancement device inside the motorcycle exhaust pipe, a second hole formed in said cylindrical body, a second threaded nut positioned over said second hole on the interior of said cylindrical body and secured in place by welding, and an anti-reversion piece threaded into said second threaded nut and projecting inwardly into the interior of the tubular cylindrical body to at least the center of the tubular body and into path of exhaust gases therethrough.

9. The device of claim 8, wherein said anti-reversion piece comprises a threaded shaft and a washer welded to said shaft.

10. An exhaust enhancement device for a motorcycle exhaust pipe comprising a tubular cylindrical body formed of steel tubing, said body having cylindrical end portions of substantially uniform diameter joined by an integral reduced diameter portion of substantially uniform diameter, a first hole formed in said cylindrical body, a first threaded nut positioned over said hole on the interior of said cylindrical body and secured in place by welding, a fastener having threads configured for engagement with said first threaded nut for securing the exhaust enhancement device inside the motorcycle exhaust pipe, a second hole formed in said cylindrical body, a second threaded nut positioned over said second hole on the interior of said cylindrical body and secured in place by welding, and an anti-reversion piece threaded into said second threaded nut and projecting into the interior of the tubular cylindrical body, the anti-reversion piece comprising a threaded shaft and a washer welded to said shaft, wherein said second hole is formed in one of said end portions, and including a third hole formed in the other one of said end portions of said cylindrical body, a third threaded nut positioned over said third hole on the interior of said cylindrical body and secured in place by welding, and an additional anti-reversion piece threaded into said third threaded nut and projecting into the interior of the tubular cylindrical body.

11. A motorcycle exhaust system comprising an exhaust pipe having an exit end, and an exhaust enhancement device mounted in said exhaust pipe adjacent the exit end thereof, said exhaust enhancement device comprising a tubular cylindrical body formed of steel tubing, said body having cylindrical end portions of substantially uniform diameter joined by an integral central portion of substantially uniform diameter, a first hole formed in said cylindrical body, a first threaded nut positioned over said hole on the interior of said cylindrical body and secured in place by welding, a threaded fastener extending through said exhaust pipe and threaded into said first threaded nut for securing the exhaust enhancement device inside the motorcycle exhaust pipe, a second hole formed in said cylindrical body, a second threaded nut positioned over said second hole on the interior of said cylindrical body and secured in place by welding, and an anti-reversion piece threaded into said second threaded nut and projecting inwardly into the interior of the tubular cylindrical body to at least the center of the tubular bode and into path of exhaust gases therethrough.

12. The system of claim 11, wherein said anti-reversion piece comprises a threaded shaft and a washer welded to said shaft.

13. A motorcycle exhaust system comprising an exhaust pipe having an exit end, and an exhaust enhancement device mounted in said exhaust pipe adjacent the exit end thereof, said exhaust enhancement device comprising a tubular cylindrical body formed of steel tubing, said body having cylindrical end portions of substantially uniform diameter joined by an integral reduced diameter portion of substantially uniform diameter, a first hole formed in said cylindrical body, a first threaded nut positioned over said hole on the interior of said cylindrical body and secured in place by welding, a threaded fastener extending through said exhaust pipe and threaded into said first threaded nut for securing the exhaust enhancement device inside the motorcycle exhaust pipe, a second hole formed in said cylindrical body, a second threaded nut positioned over said second hole on the interior of said cylindrical body and secured in place by welding, and an anti-reversion piece threaded into said second threaded nut and projecting into the interior of the tubular cylindrical body the anti-reversion piece comprising a threaded shaft and a washer welded to said shaft, wherein said second hole is formed in one of said end portions, and including a third hole formed in the other one of said end portions of said cylindrical body, a third threaded nut positioned over said third hole on the interior of said cylindrical body and secured in place by welding, and an additional anti-reversion piece threaded into said third threaded nut and projecting into the interior of the tubular cylindrical body.

* * * * *

UNITED STATES PATENT AND TRADEMARK OFFICE

CERTIFICATE OF CORRECTION

PATENT NO. : 6,848,252 B2
DATED : February 1, 2005
INVENTOR(S) : Maybeck

It is certified that error appears in the above-identified patent and that said Letters Patent is hereby corrected as shown below:

Title page showing an illustrative figure should be deleted and substitute therefor the attached title page.

Drawings, sheets 1-5 should be deleted to be substituted with the attached sheets 1-5, as shown on the attached pages.

Title page, Item [54] and Column 1, lines 1-5,
Title, "EXHAUST ENHANCEMENT FOR AFTERMARKET MOTORCYCLE EXHAUST PIPES WITH A STRAIGHT PIPE TYPE DESIGN AND WITH INSIDE PIPE DIAMETER FROM 1.875" AND LARGER" should read
-- MOTORCYCLE EXHAUST ENHANCERS --.

Column 3,
Line 22, "ThunderBolts" should read -- ThunderBolt --.

Column 5,
Line 4, "bode" should read -- body --.

Signed and Sealed this

Seventeenth Day of May, 2005

JON W. DUDAS
*Director of the United States Patent and Trademark Office*

(12) United States Patent
Maybeck

(10) Patent No.: US 6,848,252 B2
(45) Date of Patent: Feb. 1, 2005

(54) EXHAUST ENHANCEMENT FOR AFTERMARKET MOTORCYCLE EXHAUST PIPES WITH A STRAIGHT PIPE TYPE DESIGN AND WITH INSIDE PIPE DIAMETER FROM 1.875" AND LARGER

(76) Inventor: James Charles Maybeck, 115 S. Canterbury Rd., Charlotte, NC (US) 28211

( * ) Notice: Subject to any disclaimer, the term of this patent is extended or adjusted under 35 U.S.C. 154(b) by 0 days.

(21) Appl. No.: 10/408,860

(22) Filed: Apr. 7, 2003

(65) Prior Publication Data

US 2004/0123592 A1 Jul. 1, 2004

Related U.S. Application Data

(60) Provisional application No. 60/387,005, filed on Jun. 6, 2002.

(51) Int. Cl.[7] ..... F02B 27/02

(52) U.S. Cl. ..... 60/312; 60/313; 60/314; 60/322; 60/324; 181/216; 181/227; 181/241

(58) Field of Search ..... 60/312, 313, 314, 60/322, 323, 324; 181/227, 204, 215, 216, 217, 241

(56) References Cited

U.S. PATENT DOCUMENTS

| | | | | | |
|---|---|---|---|---|---|
| 4,356,885 | A | * | 11/1982 | Dello | 181/227 |
| 5,508,478 | A | * | 4/1996 | Barry | 181/227 |
| 5,663,537 | A | * | 9/1997 | Ko et al. | 181/228 |
| 6,085,863 | A | * | 7/2000 | Shuen | 181/228 |
| 6,343,673 | B1 | * | 2/2002 | Chang | 181/227 |
| 6,367,580 | B1 | * | 4/2002 | Chang | 181/241 |
| 6,520,285 | B2 | * | 2/2003 | Tobias | 181/241 |

* cited by examiner

*Primary Examiner*—Binh Q. Tran
(74) *Attorney, Agent, or Firm*—Alston & Bird LLP

(57) ABSTRACT

Sound and power are an important part of the motorcycling experience. From the early days people have been attempting to get it "right" and have tried numerous ways to achieve the best of both worlds. Generally one had to be sacrificed to some degree to get the other. Tuning the exhaust rather than tuning the carburetor or increasing cubic inches is a less expensive and more efficient way to get both the sound and midrange power that motorcyclists are looking for. With the Exhaust Enhancement exhaust pipes can be tuned for sound and increased midrange power very simply and easily by installing them in the exit end of an aftermarket straight type pipe using various combinations to achieve a desired sound and not sacrifice power.

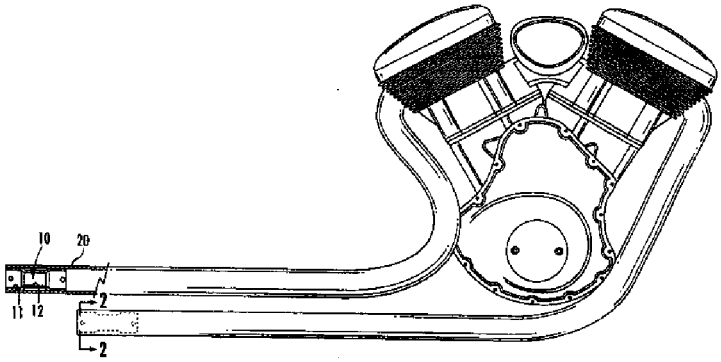

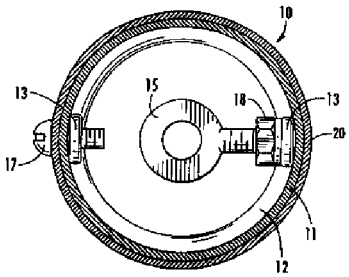

13 Claims, 5 Drawing Sheets